United States Patent [19]

Criscimagna et al.

[11] Patent Number: 4,611,203

[45] Date of Patent: Sep. 9, 1986

[54] VIDEO MODE PLASMA DISPLAY

[75] Inventors: Tony N. Criscimagna, Woodstock; Harry S. Hoffman, Jr., Saugerties; William R. Knecht, Kingston, all of N.Y.

[73] Assignee: International Business Machines Corporation, Armonk, N.Y.

[21] Appl. No.: 591,099

[22] Filed: Mar. 19, 1984

[51] Int. Cl.[4] ..... G09G 3/28

[52] U.S. Cl. ..... 340/773; 340/714; 340/771; 315/169.4

[58] Field of Search ..... 340/779, 776, 773, 771, 340/714; 358/59; 315/169.4

[56] References Cited

U.S. PATENT DOCUMENTS

| | | | |
|---|---|---|---|
| 3,940,757 | 2/1976 | Purchase | 340/773 |
| 4,176,298 | 11/1979 | Kirchner et al. | 340/714 |
| 4,247,854 | 1/1981 | Carpenter et al. | 315/169.4 |

*Primary Examiner*—Gerald L. Brigance
*Attorney, Agent, or Firm*—Joseph J. Connerton

[57] ABSTRACT

An A.C. Plasma Display Panel is operated in a video mode using the same signal train as applied to a conventional cathode ray tube terminal. For character generation, a selective erase technique is employed in which all cells in a raster line are discharged and then selectively erased in accordance with the video data to be displayed. To facilitate the erase operation, a line of cells in close proximity to the scan line being selectively erased is employed to provide adequate and uniform priming for the erase operation, and is synchronized to maintain its position with respect to the line being erased. A short plasma erase signal is utilized to fit within the scan rate of the display. The invention is also applicable to character generation in block or multi-line mode.

4 Claims, 7 Drawing Figures

VIDEO MODE PLASMA DISPLAY

CROSS REFERENCE TO RELATED PATENT APPLICATIONS

U.S. application Ser. No. 372,384 "Improved Method and Apparatus for Gas Display Panel" filed by Tony N. Criscimagna et al, June 21, 1973.

U.S. application Ser. No. 829,692 "Pilot Light Gas Cells for Gas Panels" filed by Parviz Soltan June 2, 1969, now U.S. Pat. No. 3,609,658.

BACKGROUND OF THE INVENTION

In plasma display devices, conductor arrays disposed on glass plates are overcoated with a dielectric layer, and the glass plates edge sealed with the conductor arrays disposed orthogonal to each other, the conductor intersections defining display cells. By selectively applying appropriate signals to the conductor arrays, the display cells are discharged to provide a visible display, the discharge forming a wall charge and corresponding wall charge potential on the wall of selected cells. The display is maintained by a lower amplitude sustain signal which combines with the wall charge potential formed at the selected intersections to continuously discharge the cells at about a 40 kHz rate. Selective erasing is performed by effectively neutralizing the wall charge at the selected cells such that the wall charge potential when combined with the sustain signal is insufficient to discharge the cell. The above described operation is known in the art as all points addressable (APA) plasma panel using XY addressing.

The AC Plasma Display Panel (ACPDP) would be a more flexible device if it could operate from a video interface as well as from an XY interface. With the development of video interface technology, the ACPDP's image qualities and small thin package are available to potential users regardless of the system environment.

SUMMARY OF THE INVENTION

The subject invention is directed to an AC plasma display panel which is designed to operate in a horizonal scan raster (video) mode rather than the conventional all points addressable mode normally associated with such devices. A plasma display panel was driven by a CRT controller and refreshed at a video frame rate. The panel video interface logic is driven by vertical and horizontal synchronization, video, and clock signals originating from the CRT controller. This is the identical signal sequence normally utilized for a CRT display terminal.

A particular problem in selective erasing of a plasma display device is associated with the pattern sensitivity and sequence (PASS) history of selected cells wherein a successful erase depends on ambient priming which in turn is a function of the particular pattern being erased. To resolve this problem as well as to afford compatibility for the gas panel signals in a video mode, the normal operating sequence of the PDP was modified. A write before erase sequence is employed in which a panel line of pels (picture elements) is written and then selectively erased rather than erased and then selectively written. Additionally, a complete line of data is written immediately below the scan line being selectively erased prior to erase and maintained in this relationship whereby abundant and uniform priming for the cells being erased is always provided. By eliminating the PASS problem, the operating margin of the panel is improved.

BRIEF DESCRIPTION OF THE DRAWINGS

FIG. 2*a* illustrates the erase waveform currently used in the conventional XY plasma display panel, while FIG. 2*b* illustrates the modified erase waveform used in the ACPDP video monitor.

DESCRIPTION OF A PREFERRED EMBODIMENT

Figure 1:
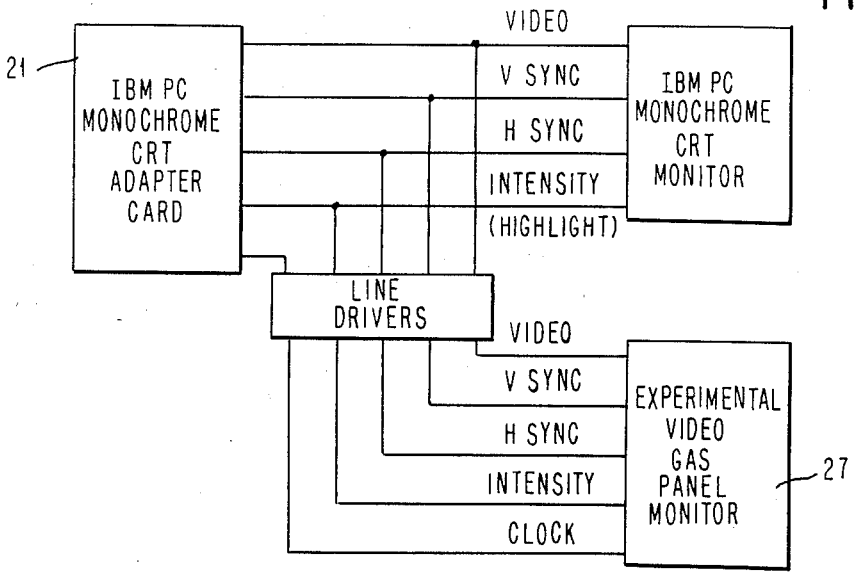
FIG. 1 illustrates in block schematic form a Personal Computer connected to a monochrome CRT monitor and to an experimental video gas panel monitor.

Referring now to the drawings and more particularly to FIG. 1 thereof, a conventional CRT controller shown as an IBM PC (Personal Computer) monochrome CRT adapter 21 has the following basic outputs; Video, Vsync, Hsync and Intensity signals. The clock signal shown in FIG. 1 is a signal required by the gas panel monitor 27. The gas panel monitor 27, like a CRT monitor, operates in a horizontal scanning mode and utilizes the same signal train to generate the display. Characters tagged for highlighting are reduced in brightness by skipping every other frame and interlacing both vertically and horizontally to handle flicker. To refresh a gas panel in video mode, a panel line can be updated by erasing and then selectively writing the video data or by writing all cells followed by selectively erasing. The latter method is employed in the preferred embodiment of the invention, as it produces less crosstalk and improves the panel's operating ranges.

Figure 2:
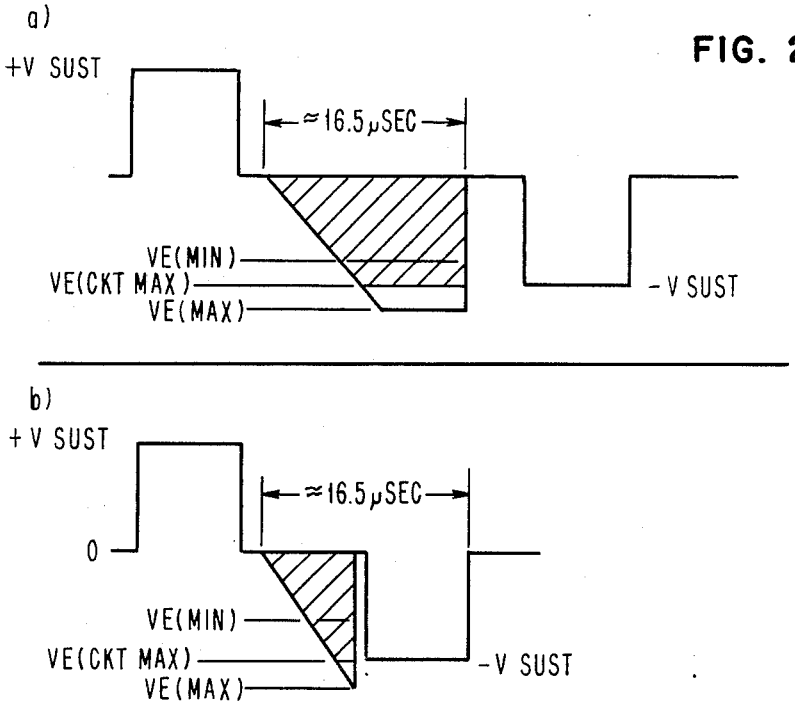

FIG. 2 illustrates the erase waveforms used by the IBM 3290 and 581 Plasma Display Assemblies, large size high resolution commercially available plasma display panels having a line resolution of 72 lines per inch and 960×768 pels (picture elements) in both conventional and video mode. In the preferred embodiment of the invention, a 720×350 section of the panel was driven by CRT monochrome adapter 21 and refreshed at a 50 frame per second rate with 3 intensity levels, normal, dim and off.

Referring to FIG. 2*a*, there is illustrated the erase waveform used in the IBM 3290 Information Processor and the IBM 581 Plasma Display Subassembly (PDSA). This erase waveform was designed to maximize write and erase operating ranges under widely varying image sequences that can occur in random X, Y addressing mode, especially in a highly interactive environment. Every erase cycle, shown as the 16.5 microsecond crosshatched waveform in FIG. 2*a*, is followed by a short burst of sustain cycles shown as +V Sust and −V Sust, to minimize or buffer the effect of the long erase cycle on the sustain function, since consecutive erase cycles take over 90 microseconds. Such time is not available for a non-interlaced video mode operation as that a faster erase waveform is required. A more complete description of the XY plasma panel operation is found in "Write and Erase Waveforms For High Resolution AC Plasma Display Panels", published in the IEEE Transactions of Electronic Devices, by T. N. Criscimagna et al, Vol. ED-28, No. 6, June 1981.

Video mode using a conventional raster scan technique does not have the widely varying image sequences available in XY addressing mode. Therefore, the write and erase waveforms can be modified without degrading the operating ranges. The conventional plasma display erase waveform is wide and operates over a large voltage range. Though it is not normally used at sustain amplitude (approximately 90 volts), it functions well at this amplitude, and the flat portion of the erase pulse can be seen to be identical to the sustain alternation that it precedes.

FIG. 2*b* illustrates the modified erase waveform used to speed up the erase operation. The rise time of FIG. 2*b* is faster and the flat sustain like portion of the erase pulse of FIG. 2*a* is eliminated. When a cell(s) is not selected for erase, the crosshatched triangular leading edge is not present, leaving a normal sustain alternation; when a cell is selected to erase, the presence of the triangular leading edge creates a waveform almost identical to the old erase waveform at sustain amplitude. Functionally, the new waveform functions like the old waveform, but is much shorter in duration. Reducing the width of the erase pulse from 16.5 to approximately 6 microseconds permitted operating in video mode.

Figure 3:
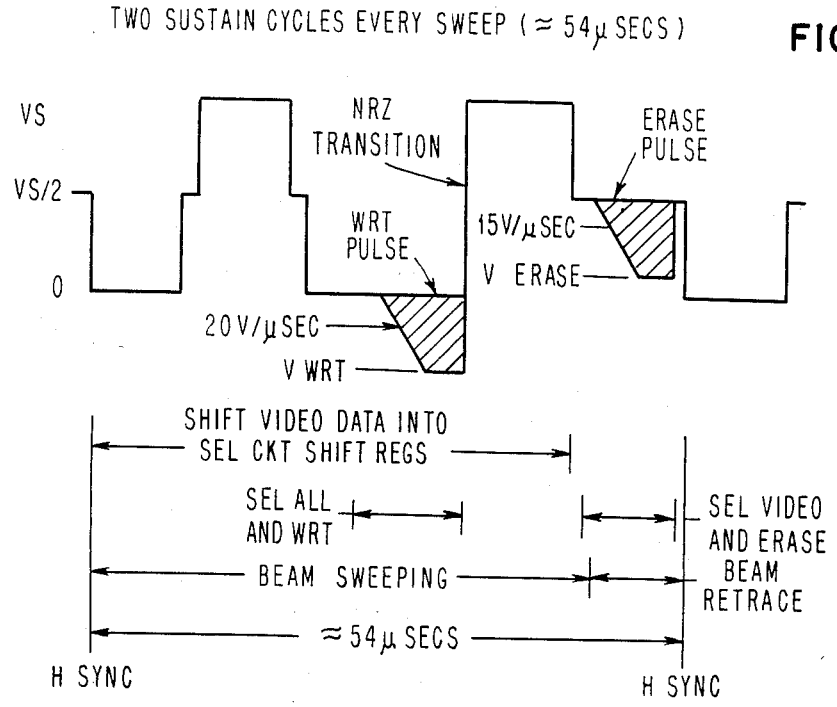
FIG. 3 illustrates the panel operations that take place during the CRT beam deflection and retrace time.

Referring now to FIG. 3, the new write and erase waveforms and a NRZ transition (non-return to zero) after the write pulse, as shown in FIG. 3, fit within the 54 microsecond horizontal scan period. The two sustain cycles within the 54 microseconds establishes a 37 kHz sustain frequency, only 3 kHz lower than the 40 kHz optimum sustain frequency for these panels. The sustain cycles previously required between consecutive write or erase operations were also eliminated. In place of a long post write pedestal to eliminate or control self erase during write, the NRZ transition reduces the tendency of the write pulse to self erase at high write amplitude. The NRZ transition represents an Engineering compromise which is not quite as effective as the post write pedestal in eliminating self erase, but allows for a much shorter write operation.

Figure 4:
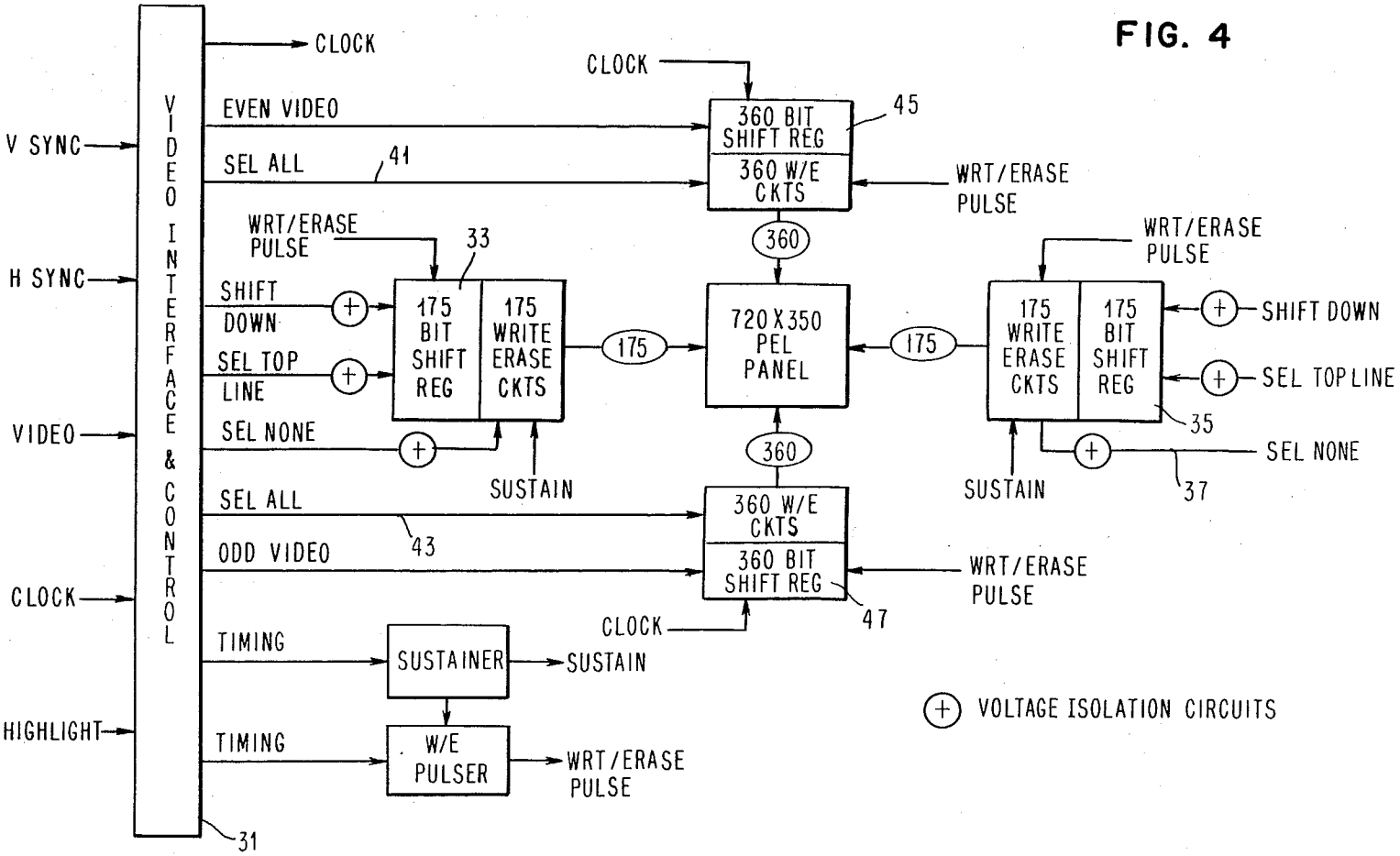
FIG. 4 is a simplified block diagram of the ACPDP video monitor.

Referring now to FIG. 4, the system which comprises the environment of the instant invention is illustrated in simplified block form. The sustain, write and erase operations are continuous, and are synchronized to the H signals and to the video data as shown in FIG. 3. The first horizontal sweeps in a frame are not accompanied by video data, and therefore write and erase pulses are not generated. The waveforms of FIG. 3 are generated with time allotted for the non existent write and erase pulses. A few sweeps later, when video data is present, the write and erase pulses are generated to update the panel lines. For convenience, alternate odd and even lines are driven from opposite sides of the panel so that two shift registers for each axis are used to store the contents of the display being generated.

The frame sequence starts with a V sync signal applied to the video control unit 31. During the vertical retrace time, all cells of the upper two panel lines 1 and 2 are selected by single one bits shifted into both horizontal selection circuit shift registers 33 and 35. The right (even) Sel None line 37 is then used to deselect line 2, leaving line 1 (odd) selected. Vertical "Sel All" lines 41, 43 are used to select all vertical lines and all cells of line 1 are turned on by writing. This completes frame initialization and the logic waits for the first active H sweep with all cells on line 1 lit. Consecutive horizontal line pairs ($\frac{1}{2}$, $\frac{2}{3}$, $\frac{3}{4}$ etc.) are selected by alternately shifting the single one bit in either the left or the right shift register, after each horizontal sweep.

When the first active H Sync signal accompanied by video occurs, line 2 of the $\frac{1}{2}$ pair is selected and all cells are written while the video data for line 1 is being shifted into the vertical shift registers 45, and 47. In the preferred embodiment of the invention herein described, a total of 720 bits of data, 360 odd and 360 even, are generated in each horizontal sweep. At this point all cells of line 1 and line 2 are on. When all the video data is loaded into the shift registers, line 1 is next selectively erased with excellent and uniform piloting provided by adjacent line 2. This pilot action virtually eliminates failures due to incomplete erasure, the heretofore defined PASS problem. Before the next H sync signal occurs, the horizontal line pair is advanced to lines $\frac{2}{3}$. The next horizontal sequence therefore turns on all the cells on line 3 and then selectively erase line 2. This horizontal sequence continues down the entire panel until one entire frame of video data is written and displayed. When the next V sync signal occurs, the next frame is initialized, as described above, and the entire sequence is repeated 50 times a second.

With respect to the erase operation, when a cell(s) is erased in an environment where there is normal piloting, the residual wall charge of the "erased" cell can be considerably greater than the OFF state wall charge. The dielectric and gas crosstalk following an adjacent cell write operation can then turn the erased cell(s) on again. As previously described, this failure mode is very sensitive to the present and past image patterns on the screen, and to the rate at which they are erased and updated. Such failures can be substantially reduced but not eliminated by careful design and control of both the pitch and the line width to gap ratios of the plasma display device. The sequence of turning on all the cells of line (n+1) and then selectively erasing the cells on line n was specifically designed to eliminate the PASS type failure in video mode operation. Only in video mode can the pattern and sequence of image updating be controlled and thereby guarantee uniform and excellent piloting.

In conventional AC plasma display devices, border pilot cells are generally employed to initially light the panel from a power-on start and to condition the cells for discharge in a write operation. However, in the instant invention, such pilot cells are not required, and the expense of pilot line driver circuits and the panel area needed for the pilot lines are not required.

Two basic test modes were used to measure the operating ranges of various panels, XY random address and video refresh mode. The XY random address mode test pattern, the PASS test, heretofore described, is a worst case testing consisting of a sequence of test patterns which promote PASS type failures by provoking noisy write and incomplete erase conditions. It is felt that video mode does not exhibit patterning sensitivity for the following reasons:

(1) the image on each line prior to each selective erasure is always the same, since all cells are lit. The history of a cell prior to erase is constant.

(2) the excellent and uniform piloting leaves a minimum of residual wall charge to guarantee the cell will remain off.

(3) selective writing, which tends to produce crosstalk, is not used.

Figure 5:
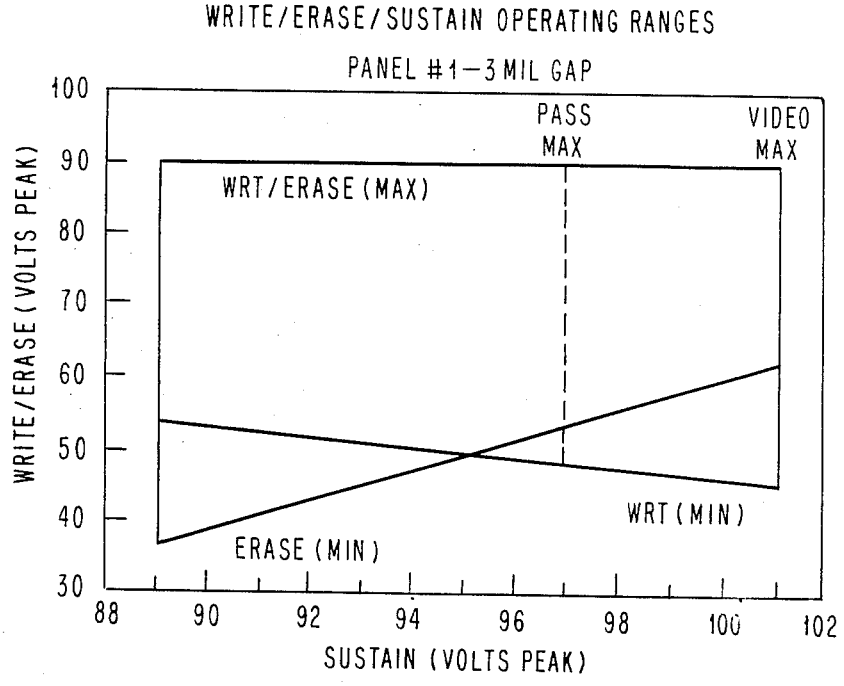
FIG. 5 illustrates the operating ranges of a 72 line per inch 3 mil gap plasma display panel operating in both XY random address and video modes.
Figure 6:
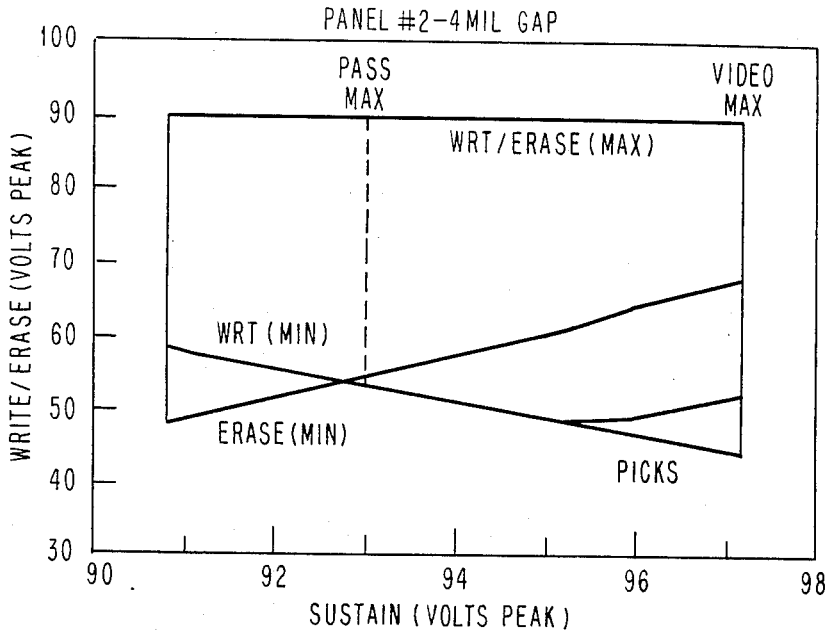
FIG. 6 illustrates the operating ranges of a 72 line per inch 4 mil gap panel operating in both XY random address and video modes.
Figure 7:
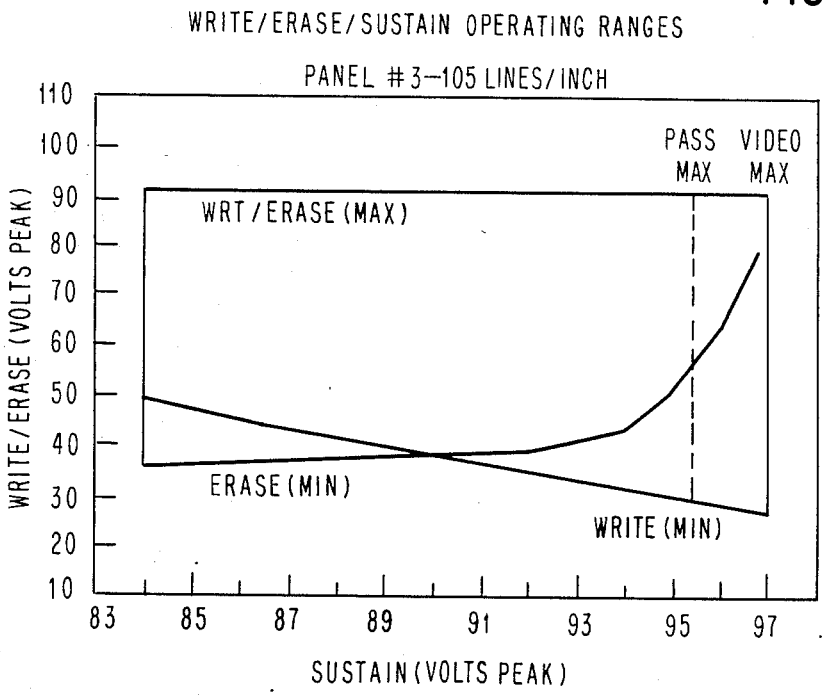
FIG. 7 illustrates the operating ranges of a higher resolution 105 line per inch small gap panel operating in both XY random address and video modes.

FIGS. 5 through 7 represent typical plots of write, erase and sustain operating ranges used in AC plasma panel operated in video mode. Experimental panels were made with chamber gaps from 3 to 4 mils, and resolution from 72 lines per inch to 105 lines per inch. Each plot in FIGS. 5 through 7 represents the operating parameters for a specified panel tested in both XY addressing and video modes. The only significant difference in operating parameters for a panel tested in both modes is the panels $V_s$max. Therefore, for simplification, the sustain write and erase minimums have been normalized and are shown as coincident, and the two $V_s$max points are labeled to illustrate the difference.

Referring first to FIG. 5, the write, erase and sustain operating ranges for a 72 line per inch panel with a 3.0 mil chamber gap and appropriate pressure and gas mixture is illustrated. The essential difference in this panel operating in both test modes was that the video mode produced a slightly larger sustain operating range then the XY address mode. The increase in $V_s$max. is attributable to the improved erase operation. $V_s$max. is one of the components of the operating margin of a panel, which is defined as the difference between the maximum sustain voltage $V_s$max and the minimum sustain voltage $V_s$min., or ($V_s$max.-$V_s$min.).

Referring next to FIG. 6, the write, erase and sustain operating ranges for a 72 line per inch panel having a 4 mil chamber gap are illustrated. The wider gap promotes crosstalk PASS failures, as evidenced by the small operating margin of only 1.6 volts, while the write and erase operating ranges were fairly normal. In the video mode, however, the panel operates very well with an operating range of 6.4 volts, even without waveform optimization in the large gap. This is a relatively dramatic increase in sustain operating range without any optimization of the write and erase waveforms. Again, this improvement is the result of the improved erase operation.

Referring finally to FIG. 7, the write, erase and sustain operating ranges of a 3 mil gap panel with a resolution of 105 lines per inch is illustrated. This panel tested rather well in both X-Y address and video mode tests. The small chamber gap required for such high resolution precludes a great deal of PASS failure. Even so, the video mode still produced a slightly larger sustain operating range.

In view of the foregoing, it is clear that an ACPDP can be used to replace a CRT as a display component in a computer terminal or monitor. In this mode, the ACPDP operates better than it does in the X, Y random address mode and has the following advantages:

1. The fast update allows for fast real time display, easy smooth scrolling and instantaneous response in highly interactive application.

2. A very simple interface is required; making it very easy to use in computer video terminals and monitors with a totally flicker-free display.

3. Improved panel yields in manufacturing because of the larger operating ranges and insensitivity to PASS type failures and relaxation of gap and line width manufacturing tolerances.

4. The pilot operation for panel start up and and write operations is no longer needed, providing a small but real cost saving.

5. Using the ACPDP in refresh mode allows the use of an inexpensive light pen designed for CRT use. This may represent a significant cost advantage, when compared to the more expensive X, Y tablets used in conventional plasma operation.

While the invention has been shown and described with reference to a preferred embodiment thereof, it will be understood that various substitutions in form and detail may be made by those skilled in the art without departing from the spirit and scope of the invention.

What is claimed is:

1. In a plasma display system adapted for character generation and display in video mode, the combination comprising;

a plasma display video monitor having a plurality of display cells arranged in a matrix configuration;

a data stream of video signals for display; and means for generating a visual representation of said data stream during a raster scanning operation, said means including;

means for applying drive signals to first and second scan lines wherein all cells in said lines are selected;

means for selectively erasing said first scan line in accordance with the contents of said data stream to be displayed;

said second scan line providing uniform priming for the selective erasure of the cells in said first scan line;

said priming permitting said selected erasure to be performed on said first scan line with short duration erase pulses; and means for synchronizing the movement of said second scan line with said raster scanning operation during said character generation whereby a line of priming cells is always maintained in the same relative position with respect to the scan line being selectively erased.

2. A device of the character claimed in claim 1 wherein said second scan line comprising said priming line is positioned contiguous to said first scan line during said selective erase operation.

3. A device of the character claimed in claim 2 wherein said second scan line is positioned immediately below said first scan line during said selective erase operation.

4. A method of operating a plasma display monitor in video mode comprising the steps of generating a data stream identifying the data to be displayed;

generating a first scan line wherein all cells are selected;

generating a second scan line wherein all cells are selected;

selectively erasing said first scan line in accordance with the contents of said data stream during a horizontal scan thereof;

said second scan line providing the priming for said selective erase; and moving said priming line in single line increments in synchronism with generating said data stream whereby said priming line is always positioned adjacent said first scan line during said selective erase operation.

* * * * *